US007727121B1

(12) United States Patent
Wang

(10) Patent No.: US 7,727,121 B1
(45) Date of Patent: Jun. 1, 2010

(54) STEPPING AND WAIST-TWISTING EXERCISER

(76) Inventor: Leao Wang, No. 1, Lane 233, Sec. 2, Chamg Long Rd., Taiping (TW) 411

( * ) Notice: Subject to any disclaimer, the term of this patent is extended or adjusted under 35 U.S.C. 154(b) by 0 days.

(21) Appl. No.: 12/470,484

(22) Filed: May 21, 2009

(51) Int. Cl.
*A63B 22/04* (2006.01)

(52) U.S. Cl. ..... 482/52; 601/35

(58) Field of Classification Search ..... 482/51, 482/52, 53, 57, 62, 146, 147, 148; 601/31, 601/35

See application file for complete search history.

(56) References Cited

U.S. PATENT DOCUMENTS 5,645,512 A * 7/1997 Yu ..... 482/53
5,749,809 A * 5/1998 Lin ..... 482/52
5,888,176 A * 3/1999 Kuo ..... 482/53
5,888,177 A * 3/1999 Lin ..... 482/57
6,582,344 B2 * 6/2003 Tang ..... 482/53
2005/0049116 A1 * 3/2005 Huang ..... 482/51

* cited by examiner

*Primary Examiner*—Loan H Thanh
*Assistant Examiner*—Tam Nguyen

(57) ABSTRACT

A stepping and waist-twisting exerciser includes a base frame with a central post near the middle part thereof. A lateral bevel gear coupled to a handlebar transmission shaft is positioned on the central post for imparting a left-and-right swing motion to a handlebar. Two longitudinal bevel gears facing to each other are rotatably disposed at the top of the central post by use of a mounting shaft 20 and engaged with the lateral bevel gear. Moreover, two rear parallel connecting rods movably attached to two coupling footboards, respectively, are connected with the longitudinal bevel gears to ensure a coordinated movement. In stepping on any one of the coupling footboards, the corresponding longitudinal bevel gear below will be rotated such that the lateral bevel gear is brought in rotation in opposite direction. In this way, an expected rotation is imparted to the handlebar. Besides, the movement of the longitudinal bevel gears enables an in-place rotation of the two corresponding coupling footboards. As result, the coupling footboards and the handlebar are brought in opposite rotation.

3 Claims, 5 Drawing Sheets

STEPPING AND WAIST-TWISTING EXERCISER

BACKGROUND OF THE INVENTION

1. Fields of the Invention

The invention relates to a stepping and waist-twisting exerciser, and more particularly, to a structure that enables the upper and lower limbs to twist in opposite direction when the operator employs his lower limb to conduct a stepping movement.

2. Description of the Related Art

As we all know, the so-called "waist twist machine" is a fitness device by which the user may twist his waist and his abdominal muscles to achieve the unique exercise effect. At present, the conventional similar devices almost employ a rotating disc as a structural basis on which a user stands to apply force for its rotation. In use, the user has to hold on a fixed handle with his both hands. At this point, the user strongly twists the lower part of his body to the left and right side. In this way, the fitness exercise of the waist and the abdominal part is achieved.

The above-mentioned fitness device can be easily operated. Moreover, there is no special mechanical design. In taking the exercise way into account, we find that the operator will be bored after using it for a certain period. The reason lies in that the above-mentioned fitness device can provide the operator only with the waist-twisting movement to the left and right sides. Thus, the conventional device requires further improvements.

SUMMARY OF THE INVENTION

A primary object of the invention is to provide a stepping and waist-twisting exerciser that permits a waist-twisting movement of the upper limb of the operator in opposite direction only by a stepping movement of the lower limb. As a result, an apparent exercise fitness effect is achieved. At the same time, the variability and the entertainment in use are considerably enhanced.

According to the invention, a lateral bevel gear is coupled with a handlebar transmission shaft for imparting a left and right swing motion to the handlebar. Thereafter, the lateral bevel gear is driven in rotation in opposite direction by the coupling footboards having the longitudinal bevel gears. In this way, the coupling footboards and the handlebar are brought in opposite twisting movement.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
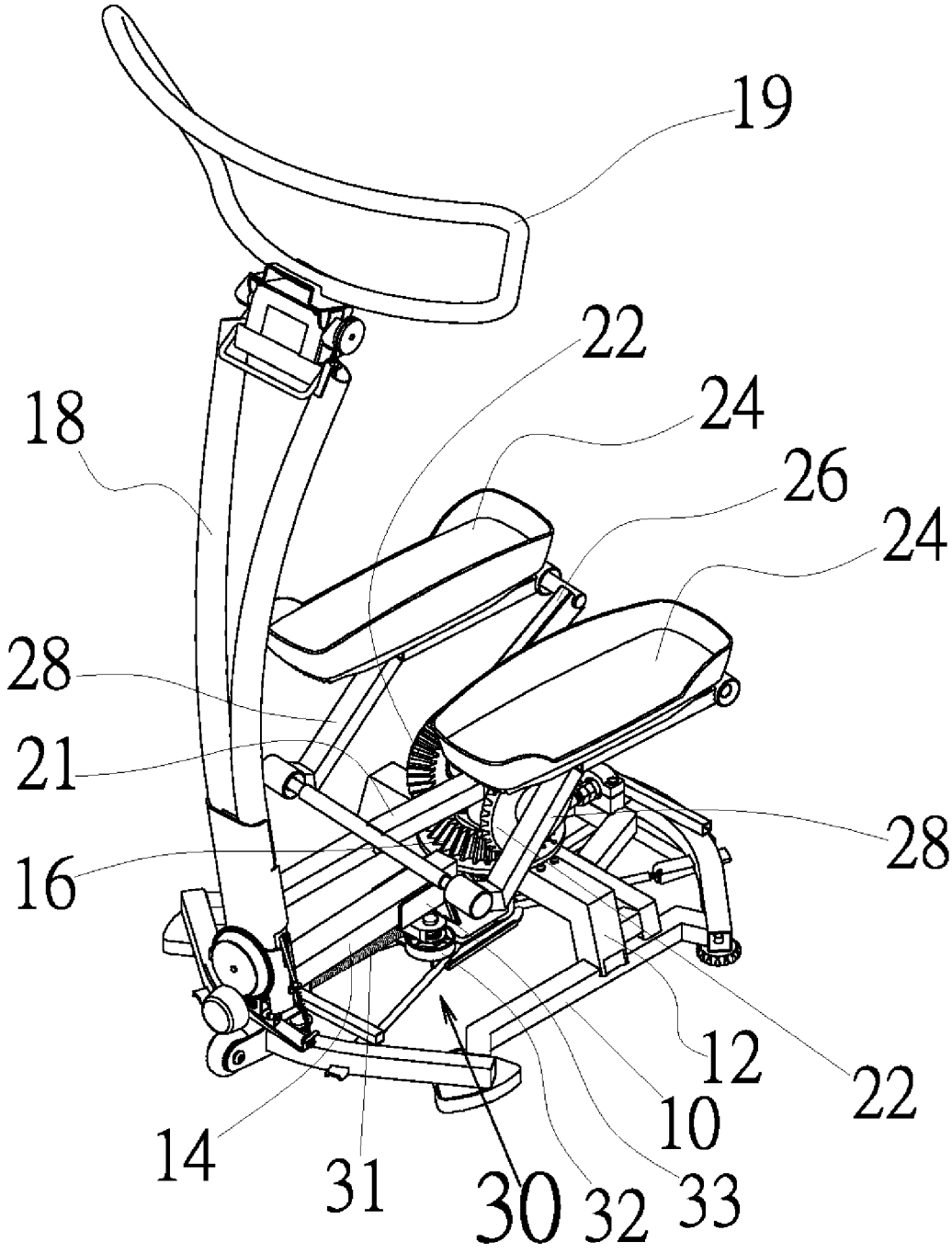
FIG. 1 is a perspective view of a preferred embodiment of the invention.
Figure 2:
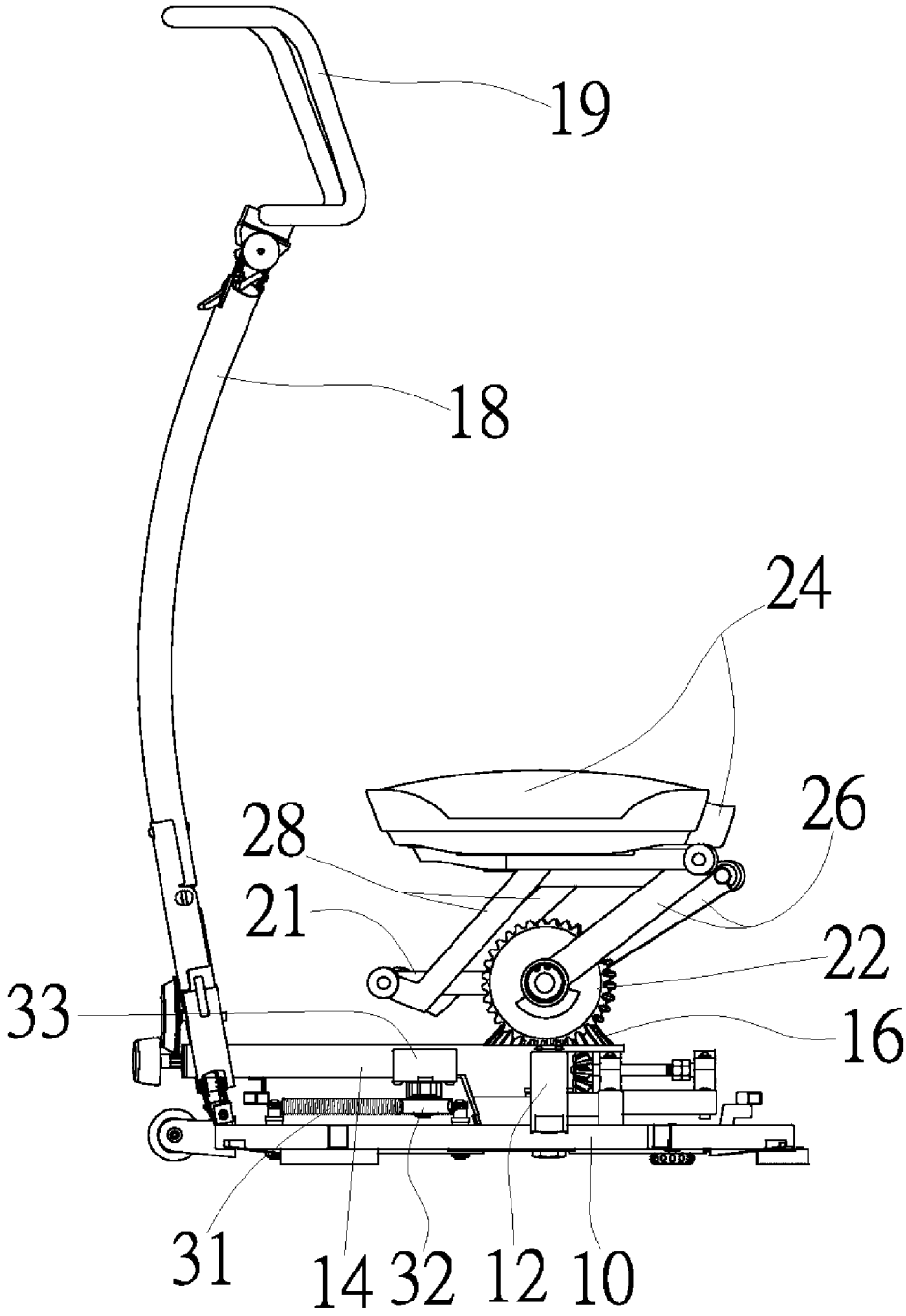
FIG. 2 is a side view of the preferred embodiment of the invention according to FIG. 1.
Figure 3:
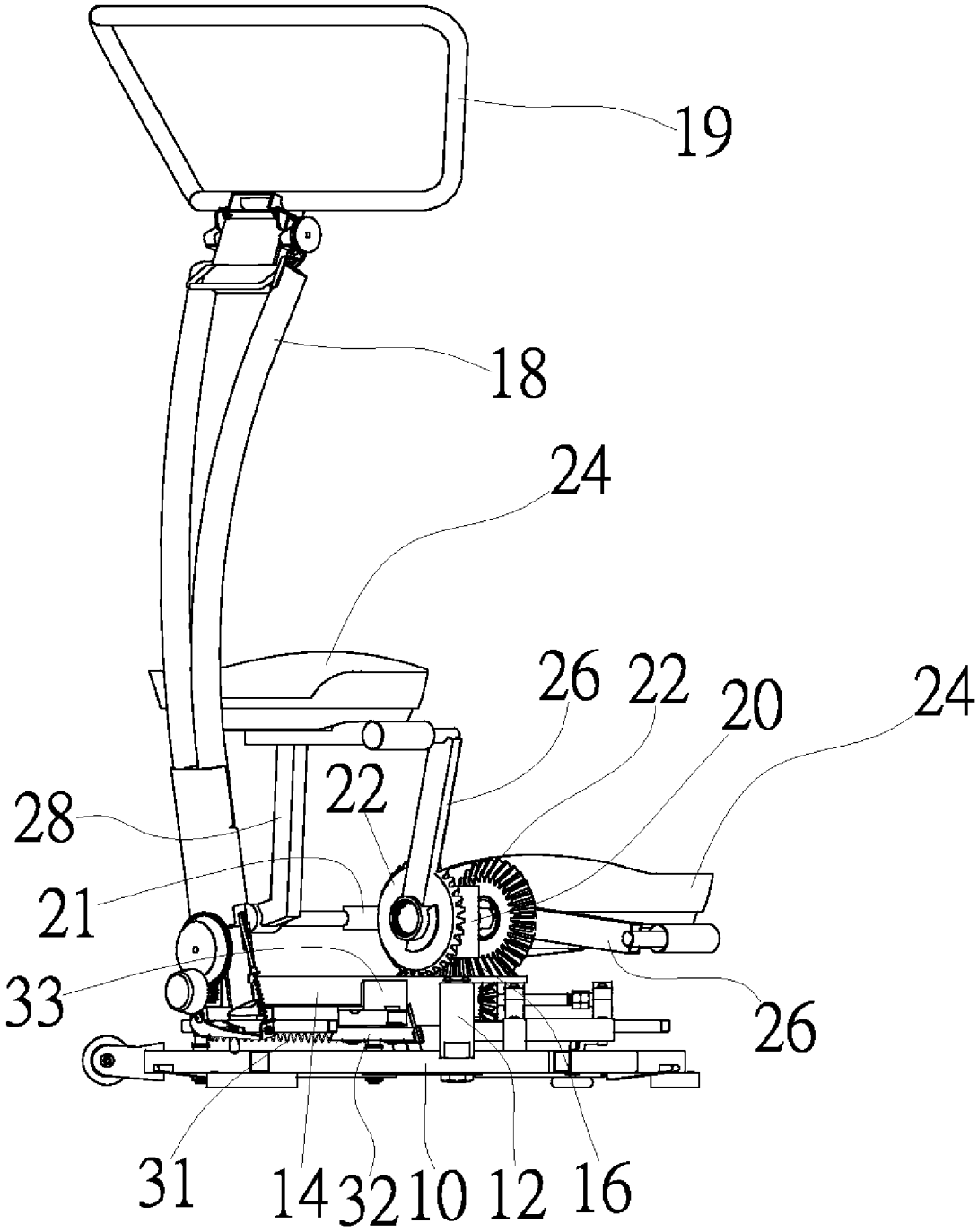
FIG. 3 is a schematic operation view of the preferred embodiment of the invention according to FIG. 1.

Referring to FIGS. 1 through 3, a stepping and waist-twisting exerciser in accordance with a preferred embodiment of the invention includes a base frame 10 with a central post 12 near the middle part thereof. A lateral bevel gear 16 coupled to a handlebar transmission shaft 14 is positioned on the central post 12 for imparting a left-and-right swing motion to a handlebar 18. Two longitudinal bevel gears 22 facing to each other are rotatably disposed at the top of the central post 12 by use of a mounting shaft 20 and engaged with the lateral bevel gear 16. Moreover, two rear parallel connecting rods 26 movably attached to two coupling footboards 24, respectively, are connected with the longitudinal bevel gears 22 to ensure a coordinated movement. In stepping on any one of the coupling footboards 24, the corresponding longitudinal bevel gear 22 below will be rotated such that the lateral bevel gear 16 is brought in rotation in opposite direction. In this way, an expected rotation is imparted to the handlebar 18. Besides, the movement of the longitudinal bevel gears 22 enables an in-place rotation of the two corresponding coupling footboards 24. As result, the coupling footboards 24 and the handlebar 18 are brought in opposite rotation.

Both coupling footboards 24 are movably coupled to a projecting fork 21 of the mounting shaft 20 via two front parallel connecting rods 28 pivoted at the bottom of the coupling footboards 24. In this way, a stable coordinated movement of four connecting rods is ensured. When the longitudinal bevel gears 22 work on the lateral bevel gear 16, the mounting shaft 20 together with both of the coupling footboards 24 will be moved left and right.

Of course, a handle 19 may be mounted at the top of the handlebar 18 for the upper limb of the operator to hold on it for a swing motion. In this way, an expected synchronic twisting effect of the upper and lower bodies is achieved.

Figure 4:
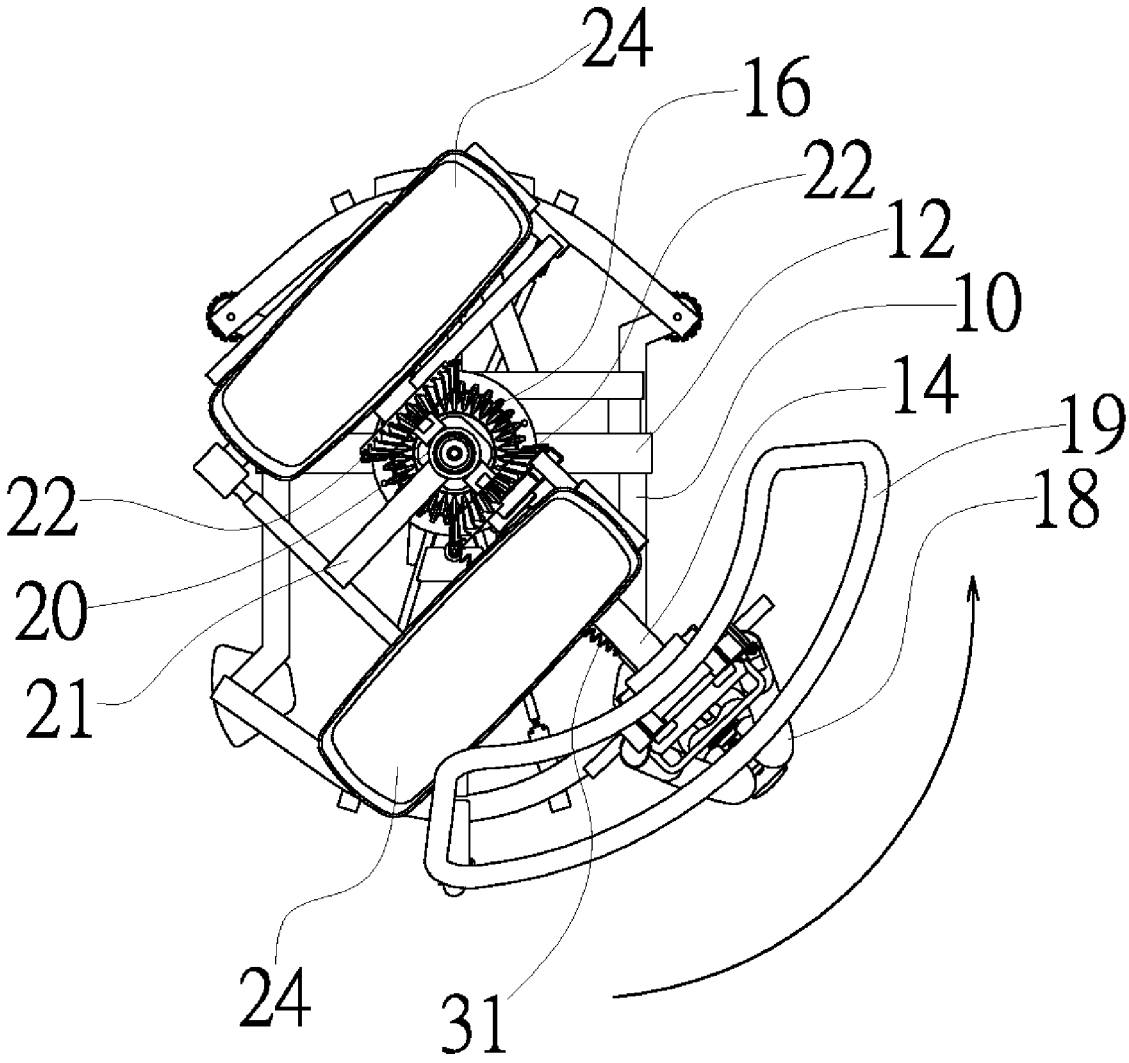
FIG. 4 is a top view of the preferred embodiment of the invention according to FIG. 3.
Figure 5:
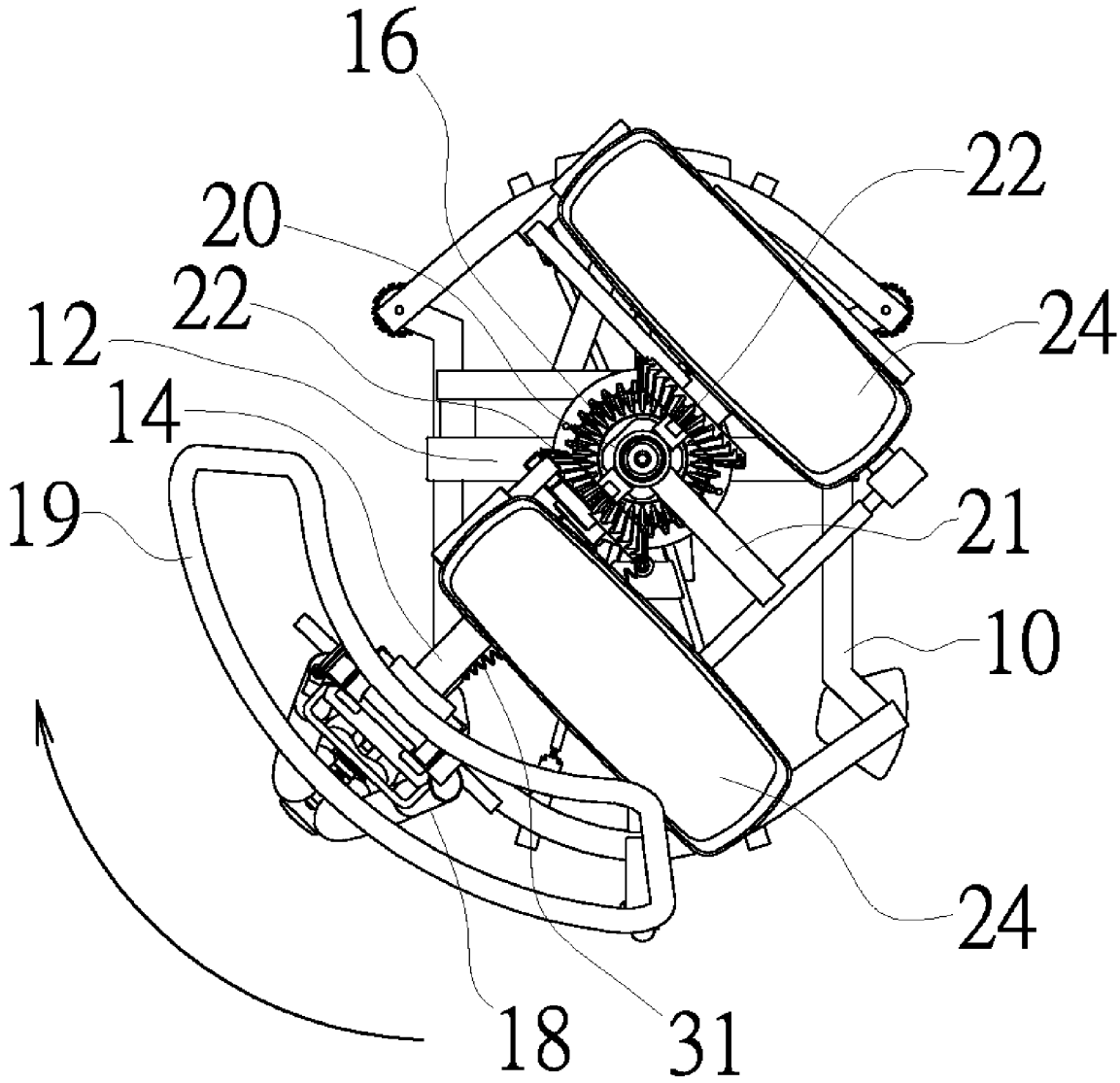
FIG. 5 is a schematic view of the invention, showing the continuous action thereof.

In addition, as shown in FIGS. 1, 4 and 5, a resistance apparatus 30 is interposed between the base frame 10 and a handlebar transmission shaft 14. The resistance apparatus 30 includes a spring 31 and an adjuster 33 with a pulley block 32. The adjuster 33 is mounted on the handlebar transmission shaft 14 while the spring 31 is fixed at the base frame 10 under the handlebar transmission shaft 14 such that the spring 31 is correctly engaged into the pulley block 32 of the adjuster 33. In applying force to the handlebar transmission shaft 14 for a swing motion to the right and right sides, the spring 31 may be pulled to create an effective exercise resistance force. Meanwhile, the adjuster 33 may be moved forward and backward to change the resistance created by the spring 31.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A stepping and waist-twisting exerciser, comprising:

a) a base frame with a central post near the middle part thereof, the central post connecting one side of the base frame to another side of the base frame;

b) a handle bar pivotally disposed on the base frame, and a lateral bevel gear positioned on a central portion of the central post for imparting a left-and-right swing motion to said handlebar;

c) a handle transmission shaft, and two longitudinal bevel gears facing to each other and each longitudinal bevel gear rotatably disposed at the top of the central post by use of a mounting shaft so as to be engaged perpendicularly with the lateral bevel gear; and d) two rear parallel connecting rods, each rear parallel connecting rod movably attached at one end thereof to one of two corresponding coupling footboards and attached at the other end thereof to one of two of said longitudinal bevel gears to ensure a coordinated movement;

wherein, in stepping on any one of the coupling footboards, a corresponding longitudinal gear, disposed below the coupling footboard that was stepped on, will be rotated such that the lateral bevel gear is brought in rotation in opposite direction; in this way, an expected rotation is imparted to the handlebar; and wherein the movement of the longitudinal bevel gears enables an a rotation of the two corresponding coupling footboards so that the coupling footboards and the handlebar are brought in opposite rotation about a vertical axis.

2. The stepping and waist-twisting exerciser as recited in claim 1, wherein both coupling footboards are movably coupled to a projecting fork of the mounting shaft via two front parallel connecting rods, each front parallel connecting rod being pivotally connected at one end thereof to the bottom of one of two of the coupling footboards, and each front parallel connecting rod being connected at the other end thereof to an end portion of the projecting fork, such that a stable coordinated movement of the four connecting rods is ensured.

3. The stepping and waist-twisting exerciser as recited in claim 1, wherein a resistance apparatus is interposed between the base frame and the handlebar transmission shaft, and the resistance apparatus includes a spring and an adjuster with a pulley block, and the adjuster is mounted on the handlebar transmission shaft while the spring is fixed at one end thereof at the base frame under the handlebar transmission shaft, and the other end of the spring in engaged to the pulley block of the adjuster such that resistance to rotation of the handlebar can be adjusted by changing the position of the pulley block along the length of the handle bar transmission shaft.

* * * * *